United States Patent [19]

Hermann, deceased et al.

[11] Patent Number: 4,493,356

[45] Date of Patent: Jan. 15, 1985

[54] ROLLER SHUTTER INSTALLATION AND SAFETY APPARATUS

[75] Inventors: Bruno Hermann, deceased, late of Keltern-Dietlingen, Fed. Rep. of Germany, by Eleonore Hermann, heir; Axel Hermann, Pforzheim, Fed. Rep. of Germany

[73] Assignee: Hermann Haus GmbH, Pforzheim, Fed. Rep. of Germany

[21] Appl. No.: 526,680

[22] Filed: Aug. 26, 1983

[51] Int. Cl.[3] ..... E06B 9/209

[52] U.S. Cl. ..... 160/133; 292/50

[58] Field of Search ..... 160/133, 176, 232, 235, 160/236; 49/322; 292/342, 345, 262, 50

[56] References Cited

FOREIGN PATENT DOCUMENTS

| | | | |
|---|---|---|---|
| 354717 | 6/1922 | Fed. Rep. of Germany | 160/133 |
| 2740869 | 3/1979 | Fed. Rep. of Germany | 160/133 |
| 2904462 | 8/1980 | Fed. Rep. of Germany | 160/133 |
| 2369408 | 6/1978 | France | 160/133 |
| 124956 | 5/1949 | Sweden | 160/201 |
| 132504 | 7/1951 | Sweden | 292/342 |

*Primary Examiner*—Peter M. Caun
*Assistant Examiner*—Cherney S. Lieberman
*Attorney, Agent, or Firm*—Balogh, Osann, Kramer, Dvorak, Genova & Traub

[57] ABSTRACT

The safety apparatus for locking slatted roller shutters is disposed in a channel-shaped shutter rail provided on the side of the roller shutter and comprises a locking device, which is connected to one end of a shutter slat and pivoted to the end of a lower slat. The locking device consists of a chain, which with its lower end is indirectly or directly secured to said lower shutter slat and which has flat links, which have sharp-edged and-/or pointed ends and which are pivoted on axes which extend substantially in the longitudinal direction of the roller slats. When an upward pushing force is exerted on the roller shutter from below, the chain will automatically wedge itself between the two mutually opposite legs of the shutter rail. No locking action will be exerted on the roller shutter.

28 Claims, 7 Drawing Figures

ROLLER SHUTTER INSTALLATION AND SAFETY APPARATUS

This invention relates to a safety apparatus for locking a slatted roller shutter. Laid-open German Application 28 30 753 discloses apparatus of that kind, which comprises a locking device, which is connected to one end of a shutter slat and is pivoted to the end of a lower shutter slat and is disposed in a U-shaped shutter rail provided on one side of the roller shutter and in response to an upward pushing force exerted on the roller shutter automatically wedges itself between the two mutually opposite legs of the shutter rail but will not exert a locking action when an upward pull is being exerted on the roller shutter. The known safety apparatus comprises a housing, which is secured to one end of a hollow slat of the roller shutter and contains a freely rotatable friction wheel, which is movable up and down in the housing. By means of a flexible metal strip or a wire rope the friction wheel is secured to an upper hollow slat of the roller shutter. The metal strip or wire rope has such a length that the friction wheel will be pulled into the housing when the roller shutter is being pulled up. On the other hand, when the roller shutter is being let down the friction wheel will emerge from the housing while being guided on an inclined surface. In that case the friction wheel exerts a wedging action by engaging one leg of the shutter rail and urging the housing against the opposite leg of the shutter rail.

The known safety apparatus is reliable in operation but its housing containing the friction wheel must have a certain minimum thickness so that the hollow shutter slats to which the safety apparatus is to be connected must be shortened to some extent in many cases in order to provide space for the safety apparatus between the ends of the shutter slats and the web of the channel-shaped shutter rail. Because the shutter slats cannot be shortened unless the roller shutter is removed, the mounting of such safety apparatus is a relatively expensive operation.

It is an object of the inventon to provide for roller shutter a safety apparatus which is very simple in design and can be mass-produced and is reliably in operation and can be mounted on the roller shutter after the latter has been installed without a need for removing the roller shutter and for shortening the shutter slats.

This object is accomplished in accordance with the invention in that the locking device comprises a chain, which at its lower end is indirectly or directly secured to a lower shutter slat and consists of flat links, which are sharp-edged and/or pointed at their ends and are pivoted only on axes which extend substantially in the longitudinal direction of the shutter slat. Additional features are recited in the dependent claims.

The chain provided according to the invention is so suspended and with its lower end is laterally secured to the roller shutter in such a manner that when the gaps between the shutter slats are opened, e.g., when the roller shutter is being pulled up, the chain will be extended to such an extent that it cannot wedge itself in the shutter rail. On the other end the point where the chain is connected to the upper shutter slat and lower mounting point of the chain should be sufficiently spaced apart so that when the roller shutter is being closed and the gaps between the shutter slats disposed between said two points are also closed the shortening of the roller shutter which is caused by the closing of said gaps will be sufficient to permit the chain to collapse to such an extent that the ends of at least part of the chain links engage one or both of the mutually opposite legs of the shutter rail. The configuration which is assumed by the chain as it collapses may be left to chance but will be zigzag-shaped in most cases. The selected orientation of the pivotal axes of the chain links has the result that the chain will always be folded in a plane which is at right angles to said axes or to the longitudinal direction of the shutter slats so that it will be ensured that during the closing of the roller shutter the sharp-edged corners or points provided at the ends of the chain links will actually move toward the two mutually opposite legs of the shutter rail.

The roller shutter is locked against being pushed up in that the sharp-edged or pointed end of at least one chain link is forced against one of the two legs of the shutter rail so that the shutter slat to which the lower end of the chain is secured constitutes an abutment and said shutter slat or at least one additional cornered or pointed end of a chain link is forced against the opposite leg of the shutter rail and a wedging action is thus effected, which opposes any upward pushing force exerted on the roller shutter.

The chain and the means for the chain may be very thin so that the existing clearance in a shutter rail will be sufficient for the accommodation of the safety apparatus without need for a shortening of the shutter slats. Besides, the safety apparatus according to the invention comprises very simple mechanical elements, which can be manufactured without an adherence to very close dimensional tolerances. For this reason the safety apparatus can be made at very low cost.

The safety apparatus has proved to be highly reliable. If the apparatus is properly mounted, the roller shutter will be reliably locked. The apparatus cannot be rendered inoperative from the outside, provided that the point at which the upper end of the chain is mounted is disposed on such a high level that said point will be disposed above the exit slot of the shutter casing even when the roller shutter is closed. That shutter casing accommodates also the roller on which the roller shutter is to be wound up, and if the number of gaps provided between the upper mounting point and the lower mounting point of the chain is sufficient, e.g., amounts to three of four gaps, corresponding to two or three roller slats, then it will be ensured that when the shutter slat that is disposed above the lower mounting point of the chain and might be accessible from the outside by a burglar is being raised the resulting increase of the length of the chain by the width of one gap will not be sufficient to entirely eliminate the wedging action of the chain.

It has also been found that the wedging action cannot be eliminated by an attempt to force a steel angle into the shutter rail and to move said steel angle upwardly as far as to the chain.

The chain links consist preferably of flat metal strips, which are connected at their ends by rivets to form a chain. The locking forces act virtually only in the plane of the sheet metal strips so that they may be relatively thin. A thickness of 1 mm is entirely sufficient. It will be desirable to use hardened chain links in order to ensure that the ends of the chain links will still be sharply cornered or pointed even when they have been used many times.

To minimize the thickness of the safety apparatus, the rivets used to interconnect the flat chain links consist suitably of countersunk rivets.

A locking action may be effected even when only one chain link is being forced against a leg of the shutter rail and the abutment required for the wedging action is formed in that the shutter slat to which the lower end of the chain is secured is forced against the opposite leg of the shutter rail. But the chain links are preferably dimensioned and interconnected in such a manner that the chain which has collapsed to a zigzag configuration will be wider than the clearance between the two opposite legs of the shutter rail because in that case the chain itself can effect a locking action as soon as it is upset in that its lower end is raised when an attempt is made to push up the roller shutter.

To permit the chain to collapse in the desired manner the chain comprises suitably at least links and preferably four to six links. In order to ensure that the upper and lower mounting points for the chain will be moved toward each other to an adequate extent when the roller shutter is being closed, at least one additional shutter slat and preferably two or three additional shutter slats should be provided between said two mounting points. The gaps which exist between said shutter slats and which close as the roller shutter is being closed whereas they are opened as the roller shutter is pulled up will determine the distance by which the upper and lower mounting points for the chain can be moved relative to each other.

It has been mentioned above that the configuration which is assumed by the chain as the roller shutter is closed may be left to chance. But a particularly reliable locking action will be achieved if the chain collapses to zigzag configuration. This can be ensured in a preferred embodiment of the invention in that each of the at least two lowermost chain links is provided at its top end with an inclined surface to the upper pivotal axis of the chain link provided with said inclined surface is so large that when the chain is extended said inclined surface will be disposed at the lower end of the next but one upper chain link and the upper inclined surfaces of consecutive chain links face the front and rear sides of the roller shutter in alternation.

Such chain links can be swung only in one direction from their position in the extended chain. This is due to the fact that the inclined surfaces face toward the front and rear sides of the roller shutter in alternation.

In a preferred arrangement, those chain links which are engaged at their lower end by the upper inclined surface of lower chain links when the chain is extended are provided at their lower end with an inclined surface which when the chain is extended has the same inclination as the adjoining upper inclined surface of the next but one lower chain link so that the inclined surfaces will then be in surface engagement with each other.

The lower end of the chain is suitably secured by a rivet to a lug which is secured to the end of a shutter slat and extends at right angles to the longitudinal direction of the shutter slat. The upper end of the chain may be mounted on a similar lug, which is secured to an upper shutter slat. The chain need not be secured directly to such lug but may be connected to it by means of a wire rope or a flexible metal strip. The flexibility should ensure that the chain and its mounting means can easily move in the curved top end portion of the shutter rail by which the roller shutter is guided inside the shutter casing to the roller. The use of the wire rope or flexible strip metal element will afford the further advantage that owing to their flexibility they will resiliently oppose any pushing force tending to raise the upper end of the chain when an attempt is made to push up the roller shutter. Such an attempt will thus be rewarded very soon.

The safety apparatus can be secured to the roller shutter in a particularly convenient manner by means of a rigid strip metal element, which extends in the longitudinal direction of the shutter slat and which is angled at one end to form a lug, which extends in the channel-shaped shutter rail at right angles to the longitudinal direction of the shutter slat and to which the chain is indirectly or directly connected at its upper end or secured at its lower end, and the strip metal element is provided with a horizontal knife edge, at the bend between that leg which extends in the longitudinal direction of the shutter slats and the lug which is angled from said leg extends at right angles from the leg that extends in the longitudinal direction of the shutter slats, and the knife edge protrudes toward that end of the strip metal element which is opposite to the lug. Such strip metal elements are secured to the inside surface of the roller shutter and are invisible from the outside. When the chain has been secured to such strip metal element, the latter and the chain can be inserted from below so that the lugs extend into the shutter rail and the strip metal element can then be raised in said shutter rail past the ends of the shutter slats until the strip metal element has reached the shutter slats to which it is to be secured. The strip metal element may be fixed simply by means of rivets or, if the shutter slats consists of wood, by screws. The strip metal element may be secured within the shutter casing although the metal strips are preferably so long that they extend sufficiently from the shutter rail so that rivets or the like can be set outside the shutter rail at least at two points which are spaced apart in the longitudinal direction of the shutter slats. This can be accomplished without opening the shutter casing.

A satisfactory positioning of the strip metal element will be achieved and the mounting will be further facilitated if the strip metal elements are provided with knife edges adjacent to the bend between the lug and the longer leg of the strip metal element. These knife edges should face the ends of the shutter slats and be adapted to be forced into said ends. Said knife edges should be substantially vertical and extend at right angles to the strap and protrude toward that end of the strip metal element which is opposite to the lug. In such an embodiment the knife edges will hold the lug in position and they will temporarily retain the strip metal elements before the latter are connected by rivets or the like to the shutter slats. The knife edges may be forced into the end faces of the shutter slats by means of an L-shaped assembling tool, which is raised in the shutter rail. When the short leg of that mounting tool is disposed beside the lug of the strip metal element and the latter is on the level of the shutter slat to which the lug is to be secured, then it will be sufficient to cant the mounting tool so that its short leg will force the knife edges into the end of the shutter slat. The strip metal elements may then be secured, e.g., by means of rivets.

Because the pushing force exerted in an attempt to push up the roller shutter will act also on the horizontal knife edge and might bend the latter, that horizontal knife edge bears preferably on one end of the vertical knife edge, which can taken up a larger pushing force and can transmit such pushing force into the long leg of the strip metal element.

A proper mounting will be effected in the simplest manner in that the upper strip metal element is first secured to the roller shutter and then the chain is permitted to hang freely when the gaps between the shutter slats are opened in the region in which the apparatus is to be mounted, so that the lower mounting point for the chain is determined, and the lower strip metal element is then secured to said lower mounting point. That assembling is so simple that it can be effected by every unskilled person.

If the chain is to be mounted at its top end by means of a rigid lever rather than by means of a wire rope or a flexible metal strip, the top end of said lever will suitably be secured to a shutter slat in such a manner that the lever can yield in an upward direction against spring force to that a length adjustment which may be required during the closing of the roller shutter will be permitted. To ensure that the lever will easily be movable through the curved entrance portion of the shutter rail in the shutter casing, the lever is desirably pivoted directly to a hollow shutter slat.

The mounting means desirably consist of a strip metal element, which is provided with a hook and is inserted into a profiled passage in a hollow shutter slat. That strip metal element has a laterally extending leg, which extends in the shutter rail transversely to the longitudinal direction of the shutter slats, and the lever is pivoted to said leg. The longer second leg of the metal strip is inserted into the profiled passage to engage the lower wall defining said passage. The hook has a pointed end, which bears on the opposite wall defining the profiled passage. In such an arrangement the outer end of the strip metal element can be raised against the spring action exerted by the hook. To ensure that the strip metal element will not slip out of the profiled passage, the pointed end of the hook is directed toward the top surface defining the profiled passage so that in response to an attempt to pull out said pointed end will tend to dig into the adjacent surface defining the profiled passage and to produce a strong locking action.

Illustrative embodiments of the invention are diagrammatically shown in the accompanying drawings, in which FIG. 1 is a side elevation showing a first embodiment of the safety apparatus when the roller shutter is closed.

In the various figures of the drawings, identical or corresponding parts are designated with the same reference characters.

Figures 1, 2, 3:
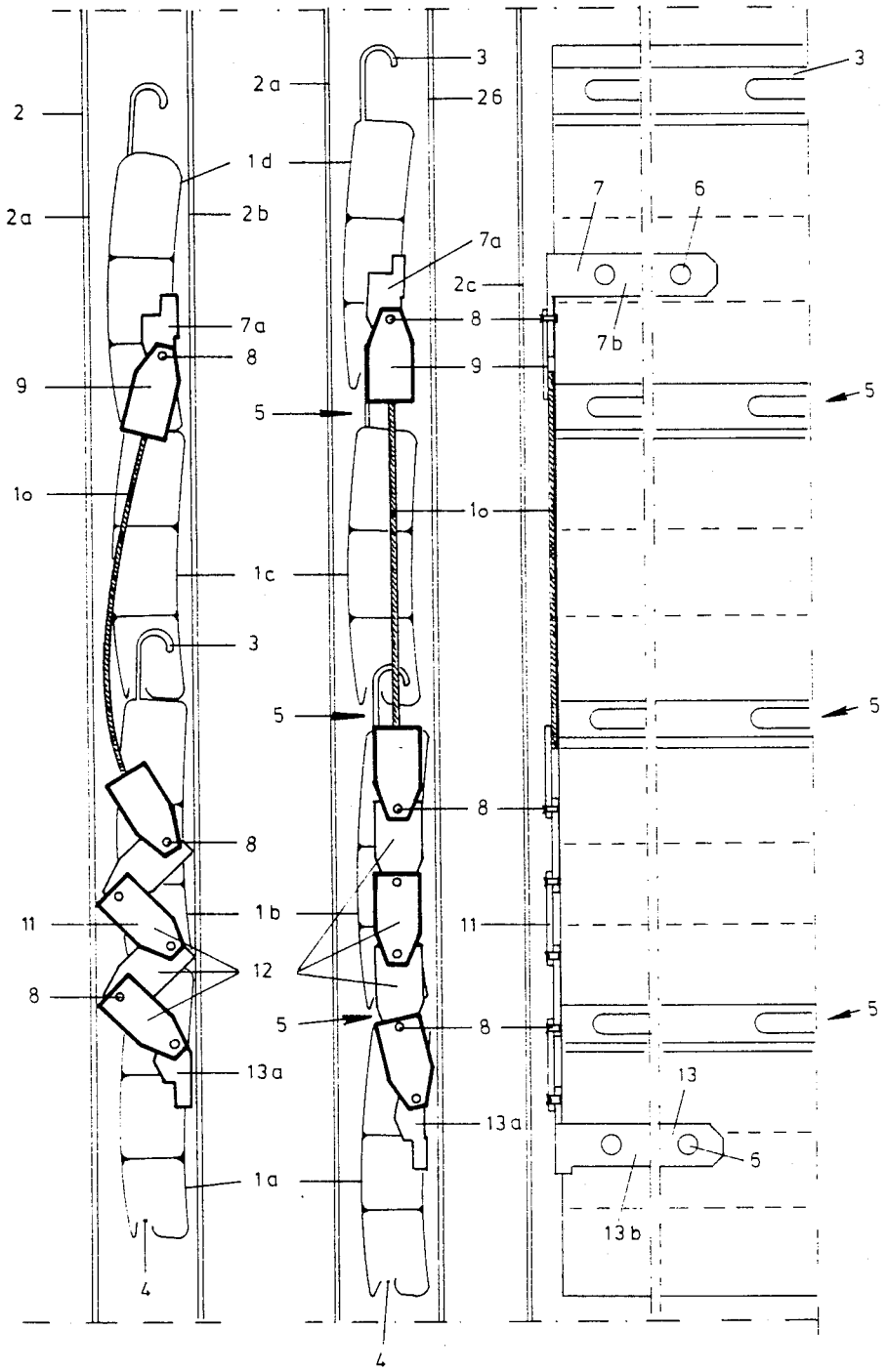
FIG. 2 is a side elevation showing the safety apparatus of FIG. 1 when the adjacent gaps of the roller shutter are open.
FIG. 3 is an elevation showing the safety apparatus as viewed from the inside of the roller shutter when the gaps of the roller shutter are open.

FIGS. 1 to 4 show a first illustrative embodiment of the invention in conjunction with a portion of a roller shutter which has been opened. The end portions of four shutter slats 1*a* to 1*d* are shown, which at their ends are guided in conventional manner in a vertically extending, channel-shaped shutter rail 2. The latter comprises two mutually opposite legs 2*a* and 2*b* and a web 2*c* joining said legs. The roller shutter is movable in the shutter rail 2 with a certain clearance. Specifically, a clearance of a few millimeters is usually provided between the ends of the shutter slats 1*a* to 1*d* and the the web 2*c*.

An L-shaped strip metal element 7 is secured by means of rivets 6 to the upper shutter slat 1*d* on that side thereof which faces the interior of the building and may be described as the rear side of the roller shutter. The shorter leg 7*a* of said strip metal element constitutes a lug, which extends transversely to the longitudinal direction of the shutter slat 1*d* and closely adjoins the end of the shutter slat 1*d*. By means of a countersunk rivet 8, a metal plate 9 is pivoted to the lug 7*a* on an axis which is parallel to the longitudinal direction of the shutter slat 1*d*. A thin wire rope 10 is secured at its top end to the metal plate 9 and the uppermost link of a chain 11 is secured to the lower end of the wire rope. The links 12 of the chain consist of flat steel plates, which have a thickness of about 1 mm and are pivotally interconnected at their ends by countersunk rivets 8 on axes which are parallel to the longitudinal direction of the roller slats 1*a* to 1*d*. Because the chain links consist of plates, the chain links will be pivotally movable only in a plane which is substantially at right angles to the longitudinal direction of the shutter slats 1*a* to 1*d*, in spite of the short length of the countersunk rivets 8. The chain links 12 are identical and have the same shape as the metal plate 9 provided on the uppermost shutter slat 1*d*. The lowermost chain link is secured at its lower end to the lug 13*a* of a strip steel element 13 which is similar to the strip steel element 7 and is secured to the inside surface of a shutter slat 1*a* also by means of rivets 6.

The positions of the two strip steel elements 7 and 13 are so selected that when the gaps 5 of the roller shutter are open (FIG. 2), the chain 11 will be almost extended whereas when the roller shutter is entirely closed so that its gaps 5 are closed the chain will be collapsed to such an extent that a plurality of chain links 12 will bear with their sharp-edged corners on the mutually opposite legs 2*a* and 2*b* of the shutter rail 2. The extent to which the chain 11 can collapse will depend on the number of gaps 5 existing between the two strip steel elements 7 and 13. In the embodiment shown by way of example three such shutter gaps 5 are provided.

The chain links 12 are so dimensioned and are so assembled to form the chain 11 that at least two chain links 12 will act on the legs 2*a*, 2*b* when the roller shutter is closed, as is shown in FIG. 1.

The chain 11 may collapse to various configurations and in most cases will collapse to a zigzag-shaped configuration, as is shown in FIG. 1. A person who attempts to push up the roller shutter from the outside will exert on the lower mounting point of the chain 11 an upwardly directed force, which tends to further upset the chain 11 and will increase the force by which the sharp-edged corners of the chain links 12 are forced against the legs 2*a* and 2*b* of the shutter rail. The resulting wedging action will lock the roller shutter so that it cannot be pushed up.

Figure 4:
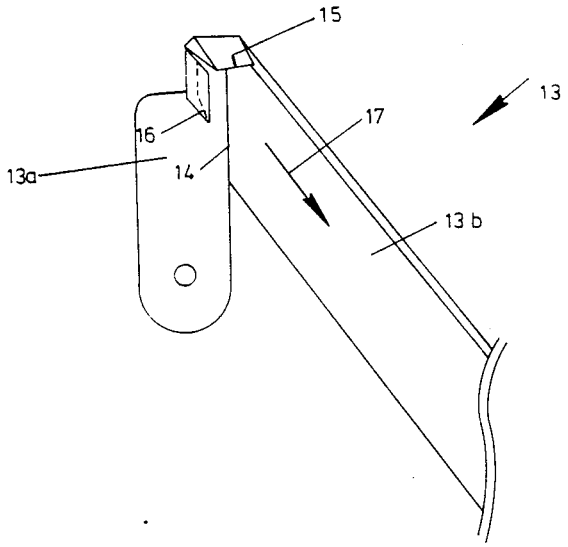
FIG. 4 is a perspective view showing the lower strip metal element for mounting the lower end of the chain.

FIG. 4 is an enlarged perspective view showing the lower strip steel element 13. A horizontal knife edge 15, which extends from the long leg 13*b*, and a vertical knife edge 16, which extends from the lug 13*a*, are provided at the bend 14 between the long leg 13*b* and the lug 13*a*. Both said knife edges 15 and 16 protrude from the lug 13*a* in the direction of the arrow 17. The knife edges 15 and 16 will dig into the end face of the shutter slat 1*a* and will thus improve the fixation of the strip steel element 13. The horizontal knife edge 15 bears on the side edge of the vertical knife edge 16 and is supported by the latter.

Figure 5:
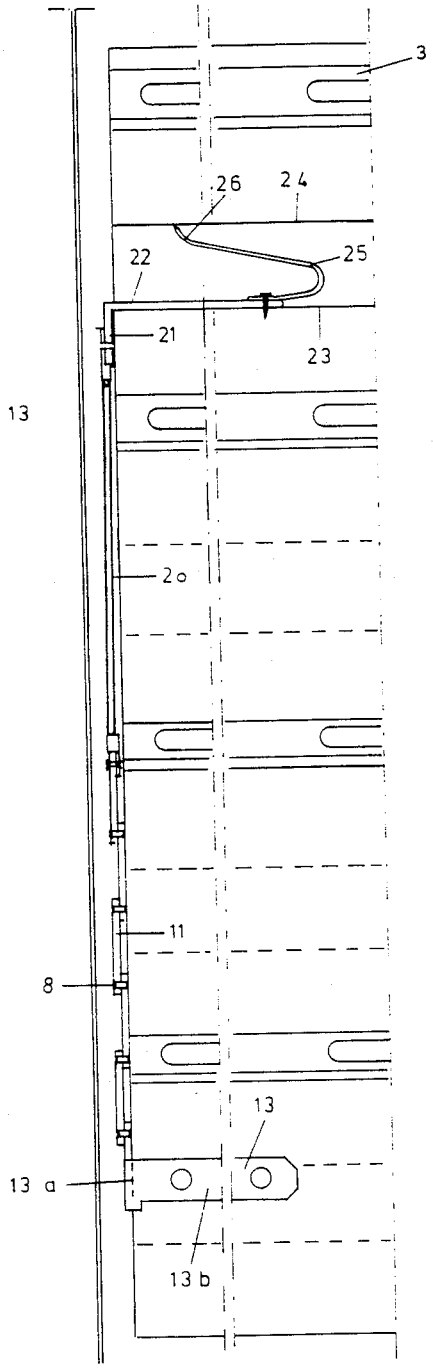
FIG. 5 is a view that is similar to FIG. 3 and shows another embodiment of the safety apparatus.

The embodiment shown by way of example in FIG. 5 differs from the one shown in FIG. 3 in that the chain 11 is mounted at its top end by a rigid lever 20 rather than by a wire rope 10. The rigid lever 20 is pivoted to an outer leg 21 of an L-shaped strip steel element on an axis which extends in the longitudinal direction of the hollow slat 1*d*. The long leg 22 of that strip steel element bears on the lower wall 23 which defines a profiled passage in the hollow slat 1*d*. A resilient hook 25 is riveted to the free end of the long leg 23 and has a pointed end 26, which extends at an oblique angle toward the opening of the profiled passage and toward the upper surface 24 defining that profiled passage and tends to dig into said upper surface so that the strip steel element 21, 22 cannot slip out of the slat 1*d*. Owing to the spring action of the hook 25 the short leg 21 disposed in the shutter rail 2 can be lifted until it engages the upper wall 24 defining the profiled passage so that length changes can be compensated.

Figure 6:
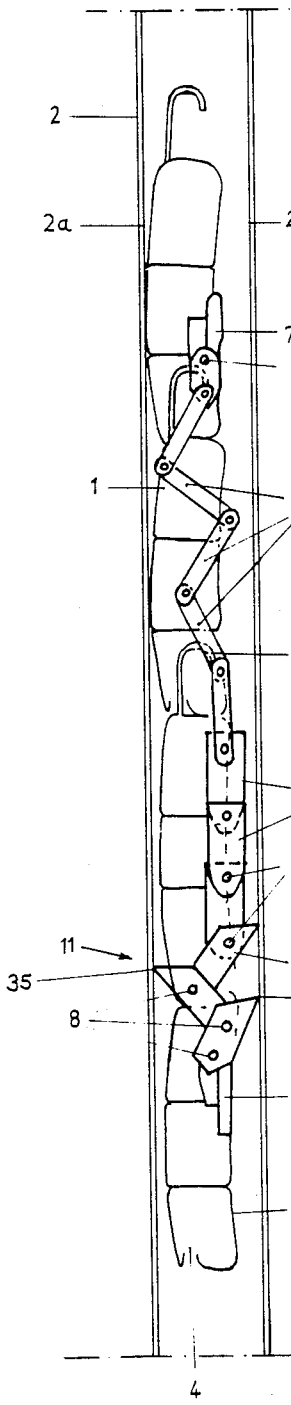
FIGS. 6 and 7 are views which are similar to FIGS. 1 and 2, respectively, and show another embodiment of the safety apparatus.
Figure 7:
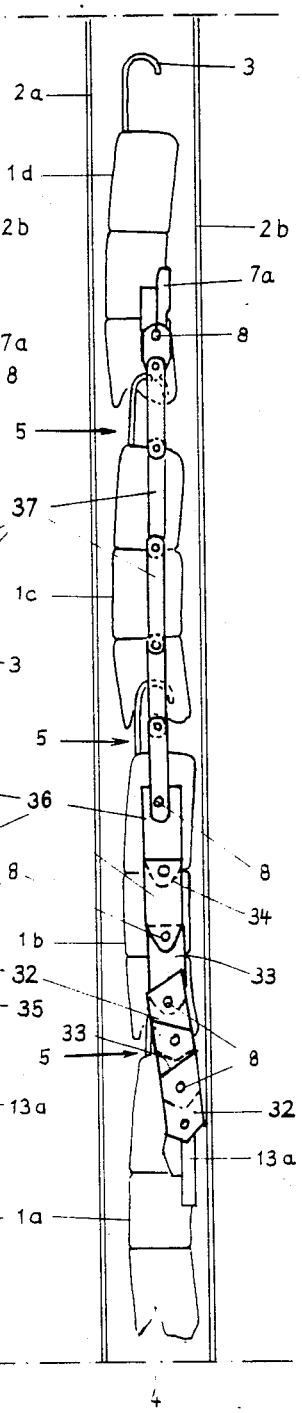

The embodiment shown in FIGS. 6 and 7 differs from the embodiment shown in FIGS. 1 to 3 substantially in the shape of the lower chain links. In the embodiment shown by way of example each of the lower five chain links 32 has at its top end an inclined surface 33 and at its bottom end an inclined surface 34, which is parallel to the inclined surface 33. The inclined surfaces 33 face in alternation toward the front and rear sides of the roller shutter. As the roller shutter is pulled the chain 11 is extended and the inclined surfaces 33 at the top end of each of the lower chain links 32 will then engage the inclined surface 34 of the next but one upper chain link. As the roller shutter is closed or during an attempt to push up the roller shutter from the outside, the inclined surfaces 33 and 34 constrain the lower chain links 32 to perform a pivotal movement only in the forward and rearward directions in alternation so that the lower portion of the chain will collapse to a zigzag configuration and the pointed apices 35 of the inclined surfaces 33 will be forced against the two mutually opposite legs 2*a* and 2*b* of the shutter rail 2.

The upper chain links 36 and 37 do not contribute to the wedging of the chain 11 so that they need not be sharp-edged. But they are also platelike, as in the embodiment shown in FIGS. 1 to 3, so that the chain links 36 and 37 will be pivotally movable substantially only in a plane which is at right angles to the longitudinal axis of the shutter bars 1*a* to 1*d*.

Another difference from the illustrative embodiments shown in FIGS. 1 to 3 and 5 resides in that in the embodiment shown in FIGS. 6 and 7 the chain 11 is secured to the upper strip steel element 7 directly rather than by means of an interposed wire rope 10 (FIGS. 1 to 3) or a rigid lever 20 (FIG. 5). Nevertheless it is possible in the chain 11 showing in FIGS. 6 and 7 to replace the upper chain links 36 and 37 entirely or in part, e.g., by a wire rope or by a flexibly resilient strip metal element or by a rigid lever. In such case the rigid lever is suitably secured to a strip steel element of the kind designated 21, 22, 25, 26 in FIG. 5. Conversely, a chain 11 of the kind shown in FIGS. 1 to 3 might be secured to the upper strip steel element 7*a* directly rather than by means of a wire rope 10, which may be replaced in that case by additional flat chain links.

What is claimed is:

1. In a roller shutter installation comprising a roller shutter comprising a plurality of parallel horizontal slats, which are adapted to be pulled apart, two channel-shaped shutter rails, each of which has mutually opposite legs and which are disposed on opposite sides of said roller shutter and adapted to receive ends of each of said slats, each of said rails having a vertical lower portion in which said ends of said slats are adapted to slide down to a position in which said shutter is in a closed position, a safety apparatus for locking said roller shutter against being pushed up from said closed position, said safety apparatus comprising a locking device, which is connected at a first mounting point to one end of a first one of said slats and at a second mounting point to the corresponding end of a second one of said slats, which is disposed below said first slat when said shutter is in said closed position, said locking device being arranged to exert a wedging action on said mutually opposite legs of the adjacent one of said shutter rails in response to an upward pushing force exerted on said second slat when said shutter is in said closed position, whereas said locking device permits said shutter to be raised from said closed position by an upwardly directed pulling force exerted on said slats and tending to move said first and second slats apart, the improvement residing in that said locking device comprises a chain having a lower end portion connected to said second shutter slat at said second mounting point and said chain consists of a plurality of flat links, each of which has mutually opposite, sharp end portions and is pivoted to adjacent ones of said links on respective axes which extend substantially in the longitudinal direction of said slats, each of said links being movable relative to said adjacent links substantially only about said axes.

2. The improvement set forth in claim 1, wherein said lower end portion of said chain is directly secured to said second slat at said second mounting point.

3. The improvement set forth in claim 1, wherein said lower end portion of said chain is connected by flexible connecting means to said second slat at said second mounting point.

4. The improvement set forth in claim 1, wherein each of said links has sharp-edged end portions.

5. The improvement set forth in claim 1, wherein each of said links has pointed end portions.

6. The improvement set forth in claim 1, wherein each of said links consists of a flat metal plate and is pivoted to adjacent ones of said links by rivets.

7. The improvement set forth in claim 6, wherein said rivets are countersunk rivets.

8. The improvement set forth in claim 6, wherein each of said links has a thickness of about 1 mm.

9. The improvement set forth in claim 1, wherein the links of said chain have such a length and are interconnected in such a manner that the chain is adapted to assume a zigzag configuration which is wider than the clearance between said two legs of said adjacent shutter rail.

10. The improvement set forth in claim 1, wherein said chain comprises at least three of said links.

11. The improvement set forth in claim 1, wherein said chain comprises four to six of said links.

12. The improvement set forth in claim 1, wherein said chain has adjacent to its lower end portion at least two lowermost links and has at least two additional links above said lowermost links, each of said lowermost links is pivoted to the next upper link on an upper pivotal axis and has an upper end portion comprising an inclined surface having a pointed apex, which is spaced from the upper pivotal axis of the same link by such a distance that said inclined surface is arranged to engage the next but one upper link at its lower end when said chain is extended as a result of an upward tensile force tending to pull said first and second slats apart, and said inclined surfaces of consecutive ones of said links face toward the front and rear sides of said shutter in alternation.

13. The improvement set forth in claim 12, wherein each of the links which are engageable by said inclined surface of an upper end portion of a lower link has a lower end portion formed with an inclined surface having the same inclination as the inclined surface of the upper end portion of the next but one lower link when the chain is extended as a result of an upward pulling force exerted on said first and second slats.

14. The improvement set forth in claim 1, wherein a rigid strip metal element having first and second legs is provided, said first leg is secured to the inside surface of one of said first and second shutter slats and extends in the longitudinal direction of said shutter slat, said second leg is angled from said first leg at one end thereof to form a bend therewith and extends in said adjacent shutter rail at right angles to said first leg, said chain is connected at one of its ends to said second leg, and said strip metal element carries at said bend a horizontal knife edge, which extends at right angles to said first leg and protrudes toward that end of said strip metal element which is opposite to said second leg.

15. The improvement set forth in claim 14, wherein said strip metal element carries a substantially vertical knife edge, which is disposed near said bend and extends at right angles to said second leg and protrudes toward said opposite end of said strip metal element.

16. The improvement set forth in claim 15, wherein said horizontal knife edge is supported by said substantially vertical knife edge at the adjacent end of the latter.

17. The improvement set forth in claim 1 as applied to a roller shutter installation in which said first slat is hollow and defines a profiled internal passage, wherein an L-shaped strip metal element is provided, which has a first leg extending in said profiled internal passage and a second leg extending from one end of said first leg and on the end face of said adjacent end of said first slat, said chain has an upper end portion, a rigid lever is connected to said upper end portion and is pivoted at its top end to said second leg, and a resilient hook is connected to said first leg at its end opposite to said second leg and overlies said first leg and has a free end which faces said adjacent shutter rail and bears on the inside surface of said first slat at the top of said profiled internal passage, whereby said hook urges said second leg and the top end of said lever downwardly.

18. The improvement set forth in claim 17, wherein said free end of said resilient hook is pointed and is upwardly inclined toward said adjacent shutter rail.

19. In safety apparatus for use in a roller shutter installation comprising a roller shutter comprising a plurality of parallel horizontal slats, which are adapted to be pulled apart two channel-shaped shutter rails, each of which has mutually opposite legs and which are disposed on opposite sides of said roller shutter and adapted to receive respective ends of each of said slats, each of said rails having a vertical lower portion in which said ends of said slats are adapted to slide down to a position in which said shutter is in a closed position, said safety apparatus being adapted to lock said roller shutter against being pushed up from said closed position and comprising a locking device, which is connected at a first mounting point to one end of a first one of said slats and at a second mounting point to the corresponding end of a second one of said slats, which is disposed below said first slat when said shutter is in said closed position, said locking device being arranged to exert a wedging action on said mutually opposite legs of the adjacent one of said shutter rails in response to an upward pushing force exerted on said second slat when said shutter is in said closed position, whereas said locking device permits said shutter to be raised from said closed position by an upwardly directed pulling force exerted on said slats and tending to move said first and second slats apart, the improvement residing in that said locking device comprises a chain having a lower end portion connected to said second shutter slat at said second mounting point and said chain consists of a plurality of flat links, each of which has mutually opposite, sharp end portions and is pivoted to adjacent ones of said links on respective axes, each of said links is movable relative to said adjacent links substantially only about said axes, and said chain is adapted to be connected to said first and second slats at said first and second mounting points, respectively, so that said axes extend substantially in the longitudinal direction of said slats.

20. The improvement set forth in claim 19, wherein each of said links consists of a flat metal plate and is pivoted to adjacent ones of said links by rivets.

21. The improvement set forth in claim 19, wherein each of said links has a thickness of about 1 mm.

22. The improvement set forth in claim 19, wherein said chain comprises at least three of said links.

23. The improvement set forth in claim 19, wherein said chain comprises four to six of said links.

24. The improvement set forth in claim 19, wherein said chain has adjacent to its lower end portion at least two lowermost links and has at least two additional links above said lowermost links, each of said lowermost links is pivoted to the next upperlink on an upper pivotal axis and has an upper end portion comprising an inclined surface having a pointed apex, which is spaced from the upper pivotal axis of the same link by such a distance that said inclined surface is arranged to engage the next but one upper link at its lower end when said chain is extended, and said inclined surfaces of consecutive ones of said links face in mutually opposite directions in alternation.

25. The improvement set forth in claim 24, wherein each of the links which are engageable by said inclined surface of an upper end portion of a lower link has a lower end portion formed with an inclined surface having the same inclination as the inclined surface of the upper end portion of the next but one lower link when the chain is extended.

26. The improvement set forth in claim 19, wherein a rigid strip metal element having first and second legs is provided, said first leg is adapted to be secured to the inside surface of one of said first and second shutter slats so that said first leg extends in the longitudinal direction of said shutter slat, said second leg is angled from said first leg at one end thereof to form a bend therewith an extends at right angles to said first leg, said chain is connected at one of its ends to said second leg, and said strip metal element carries at said bend a horizontal knife edge, which extends at right angles to said first leg and protrudes toward that end of said strip metal element which is opposite to said leg.

27. The improvement set forth in claim 26, wherein said strip metal element carries a substantially vertical knife edge, which is disposed near said bend and extends at right angles to said second leg and protudes toward said opposite end of said strip metal element.

28. The improvement set forth in claim 27, wherein said horizontal knife edge is supported by said substantially vertical knife edge at the adjacent end of the latter.

* * * * *